US008007139B2

(12) United States Patent
Ho

(10) Patent No.: US 8,007,139 B2
(45) Date of Patent: Aug. 30, 2011

(54) OPTICAL ILLUMINATION MODULE

(76) Inventor: Yen-Wei Ho, Taichung (TW)

( * ) Notice: Subject to any disclaimer, the term of this patent is extended or adjusted under 35 U.S.C. 154(b) by 302 days.

(21) Appl. No.: 12/292,002

(22) Filed: Nov. 10, 2008

(65) Prior Publication Data

US 2010/0073934 A1 Mar. 25, 2010

(30) Foreign Application Priority Data

Sep. 19, 2008 (TW) ..... 97217015 U

(51) Int. Cl.
*F21V 5/04* (2006.01)

(52) U.S. Cl. ..... 362/311.12; 362/311.02; 362/311.1; 362/335

(58) Field of Classification Search ..... 362/311.02, 362/311.1, 311.12, 311.06, 311.07, 334, 362/335, 340; 359/641, 642
See application file for complete search history.

(56) References Cited

U.S. PATENT DOCUMENTS

2008/0310166 A1* 12/2008 Chinniah et al. ..... 362/268
* cited by examiner

*Primary Examiner* — Bao Q Truong
(74) *Attorney, Agent, or Firm* — Raymond Y. Chan; David and Raymond Patent Firm

(57) ABSTRACT

The present invention relates to an optical illumination module that includes a fixed light source and a plano-convex lens. The fixed light source is a light emitting diode. The plano-convex lens is an aspheric lens with rotational symmetry, and disposed to a specific distance of an optical axis of the fixed light source. The specific distance is greater than or equal to 13.5 millimeter, and is smaller than or equal to 17.5 millimeter. The plane of the plano-convex lens is a light-beam incident plane, and a convex end is a light-beam exit plane. When the fixed light source is disposed at a coordinate origin, the convex curve of the plano-convex lens is composed of a series of points having specific coordinates. When the plano-convex lens shifts within the specific distance, a parallel light beam form the fixed light source can be refracted to achieve an effect of enhancing the uniformity of luminous brightness.

15 Claims, 2 Drawing Sheets

OPTICAL ILLUMINATION MODULE

FIELD OF THE INVENTION

The present invention relates to an optical illumination module and more particularly to the optical illumination module that is applied to a flashlight or various illumination lamps to generate a light beam with an optimum included angle.

BACKGROUND OF THE INVENTION

In a conventional structure, a flashlight capable of condensing light includes a flashlight main body, a lamp seat, a lamp housing set and an optical carrier with high transmittance. The flashlight main body has a battery sleeve for accommodating a battery. The lamp seat is provided for disposing and connecting light emitting elements, and disposed in front of the flashlight main body. The lamp housing set is put to the front of the flashlight main body to protect the lamp seat and the light emitting elements. The characteristic of the flashlight is that: the optical carrier is an optical transparent lens in disk shaped. Two sides of the optical carrier have convex arc surfaces with circular section diameter, so that the circular section diameter of the convex arc surface of the front is bigger and the circular section diameter of the convex arc surface of the rear is smaller. Therefore, the optical carrier capable of condensing light and having transmittance is composed, and disposed and fastened to the lamp housing set for positioning. The lamp housing set is assembled to the front of the flashlight main body together with the optical carrier to enable the optical carrier to be disposed in front of the light emitting elements, thereby assembling the flashlight capable of condensing light.

The optical carrier adopted by the foregoing conventional structure shows the convex arc surfaces at the two sides. The two convex arc surfaces are circular sections. Namely, the conventional lens design applied to the illumination lamps is a sphere surface. When a light source is placed to the focus of an end of the sphere surface, light will be refracted from another end after refracting. A parallel light beam will be theoretically obtained and the minimum emergence angle is taken. However, when a sphere convex lens is practically adopted, the parallel light beam is unable to be acquired completely. The scattered light still appears after refracting the light source.

SUMMARY OF THE INVENTION

A primary objective of the present invention is to provide an optical illumination module capable of increasing the condensing capability in the illumination area and enhancing uniformity and luminous intensity.

To achieve the foregoing objective, an optical illumination module of the present invention includes a fixed light source and a plano-convex lens. The fixed light source is a light emitting diode, and disposed to a coordinate origin. The plano-convex lens is disposed to a specific distance of an optical axis direction of the fixed light source. The plano-convex lens is a rotational symmetrical aspheric design with proper thickness. The curvature of any point that forms the convex may be different. In addition, the composition feature of the convex curve of the plano-convex lens is further described in detail. When the fixed light source is disposed to the coordinate origin, coordinates (X, Y) of points at the convex curve of forming the plano-convex lens are (9, 11.75), (8, 13.15), (6, 15.25), (4, 16.65), (2, 17.45), (0, 17.65), (−2, 17.45), (−4, 16.65), (−6, 15.25), (−8, 13.15), (−9, 11.75) respectively. The convex curve composed of the foregoing specific coordinates is that the curve variation is within ±1 millimeter. The plano-convex lens can shift within the specific distance between the fixed light source and the plano-convex lens, so that a light beam generated by the fixed light source can be refracted through a convex end of the plano-convex lens, thereby enhancing the luminous intensity.

The plano-convex lens composed of the foregoing coordinates is that the thickness between the plane and a convex apex is greater than or equal to 6 millimeter, and is smaller than or equal to 10 millimeter. The convex curve can be scaled according to the foregoing coordinates and the thickness to still maintain equivalence.

Moreover, the present invention also provides an optical illumination module that includes a fixed light source and a plano-convex lens. A distance between the fixed light source and a convex apex of the plano-convex lens is greater than or equal to 13.5 millimeter, and is smaller than or equal to 17.65 millimeter.

The present invention further provides an optical illumination module that includes a fixed light source. In an optical axis of the fixed light source, a distance between a plane and a convex apex of a plano-convex lens is greater than or equal to 6 millimeter, and is smaller than or equal to 10 millimeter. The coordinates (X, Y) of the convex curve are composed of (9, 11.75), (8, 13.15), (6, 15.25), (4, 16.65), (2, 17.45), (0, 17.65), (−2, 17.45), (−4, 16.65), (−6, 15.25), (−8, 13.15), (−9, 11.75) respectively.

By using the foregoing technical means, the optical illumination module composed of the aspheric plano-convex lens and the fixed light source. Further, a distance between the lens and the light source is greater than or equal to 13.5 millimeter, and is smaller than or equal to 17.5 millimeter to form a scope. The aspheric plano-convex lens with rotational symmetry is disposed to the plane of the plano-convex lens to space the fixed light in a specific distance. Accordingly, when the plano-convex lens is positioned at the foregoing specific distance, the light beam generated by the fixed light source can be refracted by the convex end of the plano-convex lens as the minimum emergence angle to increase the condensing capability of the illumination area and enhance the uniformity and luminous intensity.

Other features and advantages of the present invention and variations thereof will become apparent from the following description, drawings, and claims.

DETAILED DESCRIPTION OF THE PREFERRED EMBODIMENTS

Other features and advantages of the present invention will become apparent from the following description of the invention which refers to the accompanying drawings.

Figure 1:
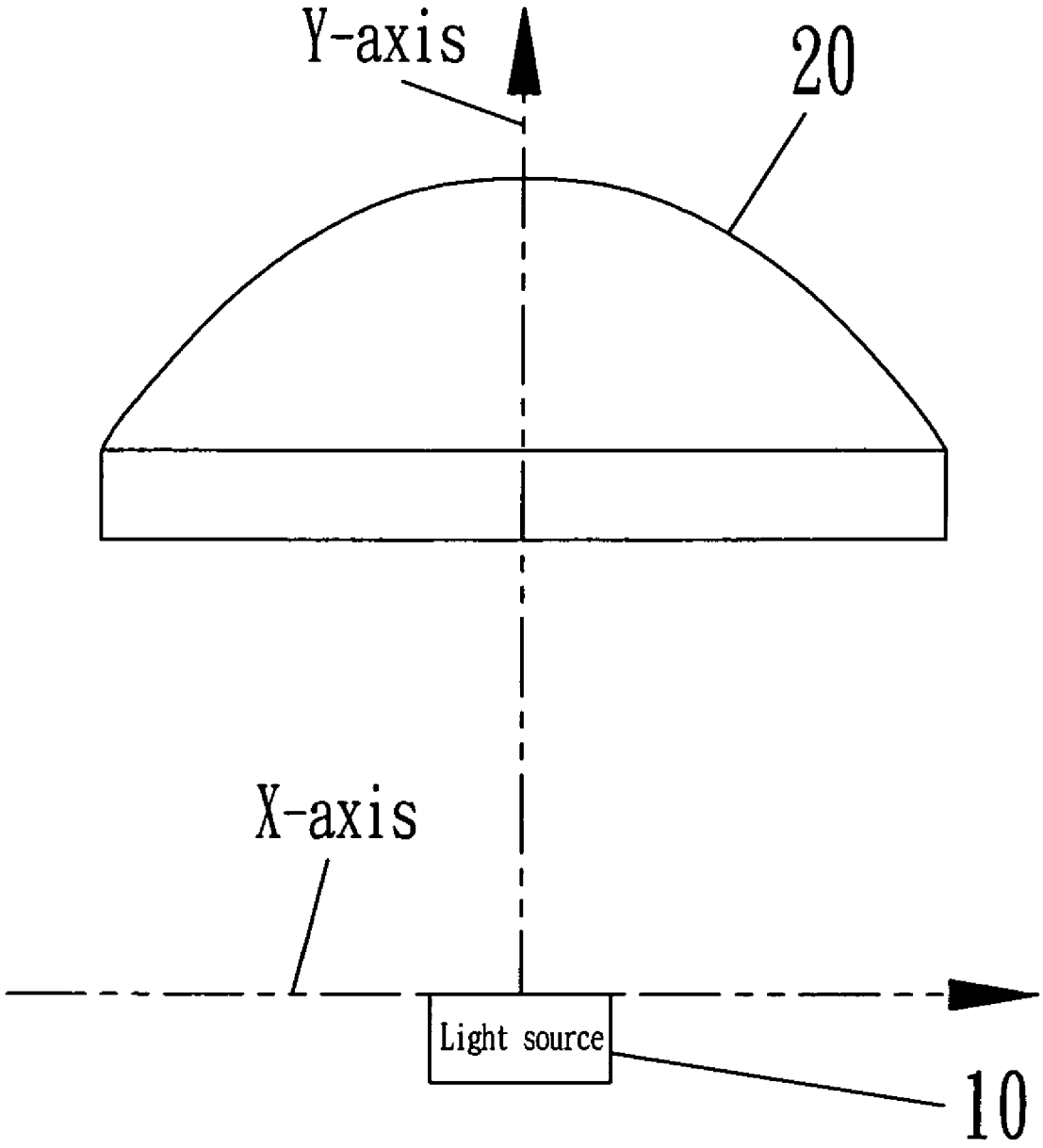
FIG. 1 is a schematic diagram of a relative position according to a preferred embodiment of the present invention.

First, FIG. 1 is a schematic diagram of an optical illumination module according to a preferred embodiment of the present invention. The module includes a fixed light source 10 and a plano-convex lens 20. The fixed light source 10 is a light emitting diode. The plano-convex lens 20 is disposed to a specific distance of an optical axis. The specific distance is greater than or equal to 13.5 millimeter, and is smaller than or equal to 17.65 millimeter. The distance is defined between the fixed light source 10 and a convex apex of the plano-convex lens 20.

The plano-convex lens 20 is a lens with rotational symmetrical aspheric design. Its plane is taken as a light-beam incidence plane and a convex end is taken as a light-beam exit plane. When the fixed light source 10 and the plano-convex lens 20 are within the foregoing specific distance, a distance between the plane and the convex apex of the plano-convex lens 20 is greater than or equal to 6 millimeter, and is smaller than or equal to 10 millimeter so as to achieve an ideal mode. To further define the composition value of the convex curve of the aspheric plano-convex lens 20, the fixed light source 10 is temporarily disposed to the position of coordinates (X, Y) and origin (0,0). The coordinates (X, Y) of points at the convex curve of the plano-convex lens 20 are shown in Table 1:

TABLE 1

Figure 2:
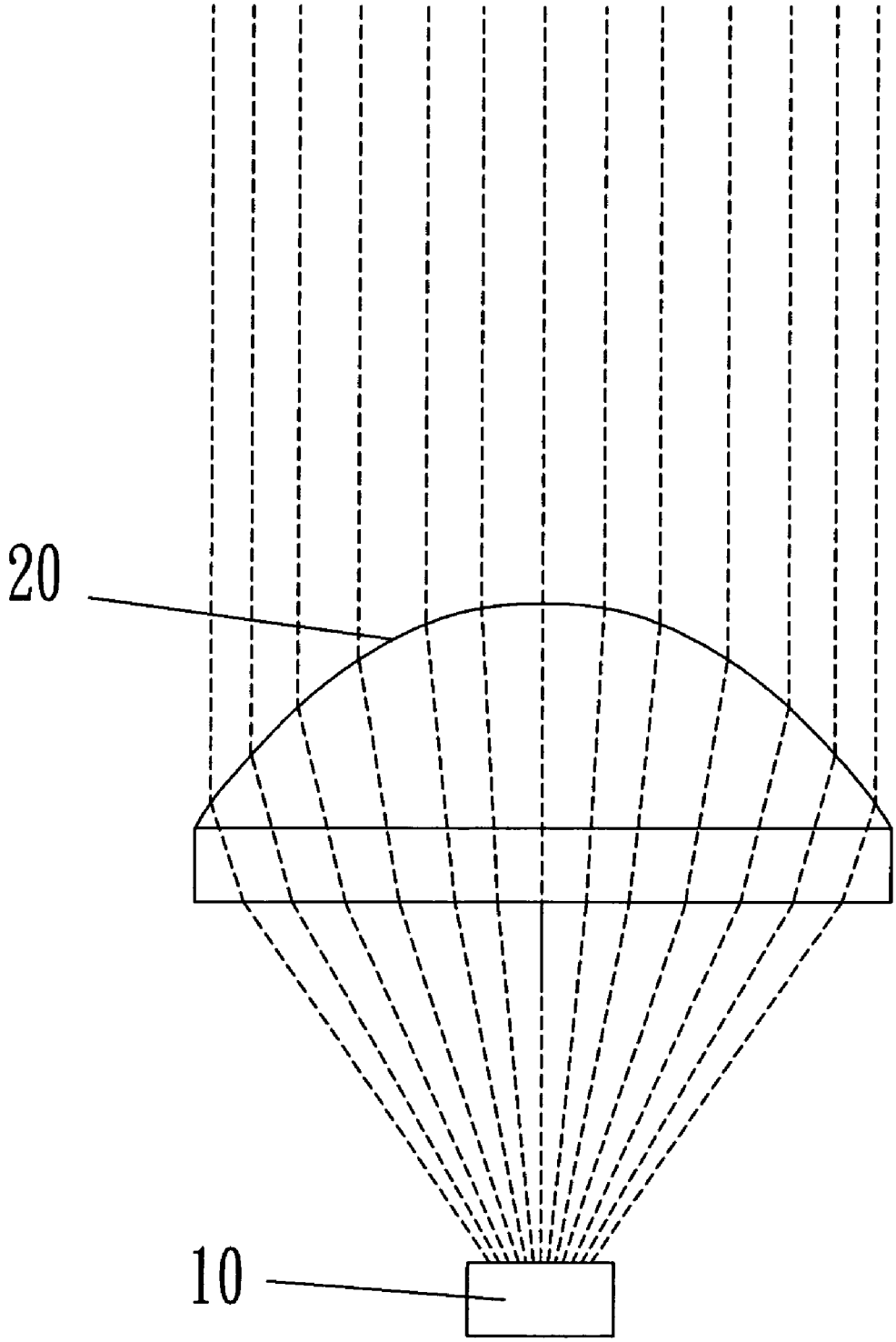
FIG. 2 is a schematic diagram of refraction according to a preferred embodiment of the present invention.

| X-axis | Y-axis | X-axis | Y-axis |
|---|---|---|---|
| 0 | 17.65 | — | — |
| 2 | 17.45 | −2 | 17.45 |
| 4 | 16.65 | −4 | 16.65 |
| 6 | 15.25 | −6 | 15.25 |
| 8 | 13.15 | −8 | 13.15 |
| 9 | 11.75 | −9 | 11.75 |

including (9, 11.75), (8, 13.15), (6, 15.25), (4, 16.65), (2, 17.45), (0, 17.65), (−2, 17.45), (−4, 16.65), (−6, 15.25), (−8, 13.15), (−9, 11.75) respectively. The convex curve composed of the foregoing specific coordinates is that the curve variation is within ±1 millimeter. The plano-convex lens 20 can shift within the specific distance between the fixed light source 10 and the plano-convex lens 20 (as shown in FIG. 2), so that a light beam generated by the fixed light source 10 can be refracted by the convex end of the plano-convex lens 20 as a small emergence angle to enhance the luminous intensity in the effective illumination area.

In addition, the plano-convex lens 20 of the optical illumination module is that the convex curve can be scaled according to the coordinates of points and the thickness of the plano-convex lens 20 to enable the light beam generated by the fixed light source 10 to be refracted as small luminous angles, thereby enhancing the luminous intensity and lengthening the luminous distance.

Moreover, the aspheric multi-curve table (as shown in Table 1) is formed by an aspheric curvature of the plano-convex lens 20. The convex of the aspheric plano-convex lens 20 also satisfies the following conditions:

$$sag(\rho) = \frac{\rho^2/r}{1+\sqrt{1-(1+c)(\rho/r)^2}} + d\rho^4 + e\rho^6 + f\rho^8 + g\rho^{10} + h\rho^{12} \ldots l\rho^{20}$$

wherein ρ is a spacing between the aspheric curve and the ideal plane, which means a polar coordinate of the distance of the sphere center of the aspheric surface;

r is an aspheric radius of the plano-convex lens 20;

c is a second order aspheric coefficient;

d, e, f, g, h, . . . , 1 are polynomial aspheric coefficients.

However, the size of the aspheric surface is not limited. When the radius of the plano-convex lens 20 is defined in a range between 3 millimeter and 10 millimeter, the curve of the curvature variation is clipped by two parabolas. The aspheric curve formed by the curvature variation from any one point of the aspheric surface of the present invention is between the two parabolas.

The distance between the aspheric plano-convex lens 20 and the fixed light source is greater than or equal to 13.5 millimeter, and is smaller than or equal to 17.65 millimeter. The distance is defined between the convex apex and the fixed light source.

Although the features and advantages of the embodiments according to the preferred invention are disclosed, it is not limited to the embodiments described above, but encompasses any and all modifications and changes within the spirit and scope of the following claims.

What is claimed is:

1. An optical illumination module, the characterized in that: a fixed light source disposed to a coordinate origin; and a plano-convex lens with rotational symmetrical aspheric feature in which coordinates (X, Y) of points at a convex curve are (9, 11.75), (8, 13.15), (6, 15.25), (4, 16.65), (2, 17.45), (0, 17.65), (−2, 17.45), (−4, 16.65), (−6, 15.25), (−8, 13.15), (−9, 11.75) respectively, and a curve variation of the convex curve composed of the coordinates is within ±1 millimeter, and a light beam generated by the fixed light source is refracted as a parallel light beam from an convex end.

2. The optical illumination module as claimed in claim 1, wherein a distance between a plane and a convex apex of the plano-convex lens is grater than or equal to 6 millimeter, and is smaller than or equal to 10 millimeter.

3. The optical illumination module as claimed in claim 1, wherein the fixed light source is a light emitting diode.

4. The optical illumination module as claimed in claim 1, wherein the convex curve of the plano-convex lens is scaled according to the coordinates.

5. The optical illumination module as claimed in claim 1, wherein 17. 65 millimeter defined to a distance between the fixed light source disposed at the coordinate origin and the convex apex of the plano-convex lens is an optimal focus distance, and a distance error is within ±1 millimeter.

6. An optical illumination module for generating a light beam with an optimum included angle, comprising:

a fixed light source disposed to a coordinate origin; and a plano-convex lens with rotational symmetrical aspheric feature in which coordinates (X, Y) of points at a convex curve are (9, 11.75), (8, 13.15), (6, 15.25), (4, 16.65), (2, 17.45), (0, 17.65), (−2, 17.45), (−4, 16.65), (−6, 15.25), (−8, 13.15), (−9, 11.75) respectively, defining a distance between the fixed light source and the plano-convex lens, wherein a curve variation of the convex curve composed of the coordinates is within ±1 millimeter, and a light beam generated by the fixed light source is refracted as a parallel light beam from an convex end, wherein when the plano-convex lens shifts within the distance between the fixed light source and the plano-convex lens, the light beam generated by the fixed light source is refracted as the parallel light beam from the convex end, whereby the light beam with the optimum angle is generated through the plano-convex lens from the fixed light source.

7. The optical illumination module, as recited in claim 6, wherein a distance between a plane and a convex apex of the plano-convex lens is grater than or equal to 6 millimeter, and is smaller than or equal to 10 millimeter.

8. The optical illumination module, as recited in claim 6, wherein the fixed light source is a light emitting diode.

9. The optical illumination module, as recited in claim 6, wherein the convex curve of the plano-convex lens is scaled according to the coordinates.

10. The optical illumination module, as recited in claim 7, wherein the convex curve of the plano-convex lens is adjustable based on the particular relationship set though the distance between the plane and the convex apex of the plano-convex lens and the coordinates (X, Y) of points of the plano-convex lens.

11. A method of generating a light beam with an optimum included angle, comprising the step of:

(a) providing a fixed light source disposed to a coordinate origin arranged for generating a light beam;

(b) refracting the light beam through an optical illumination module consisting of a plano-convex lens with rotational symmetrical aspheric feature in which coordinates (X, Y) of points at a convex curve are (9, 11.75), (8, 13.15), (6, 15.25), (4, 16.65), (2, 17.45), (0, 17.65), (−2, 17.45), (−4, 16.65), (−6, 15.25), (−8, 13.15), (−9, 11.75) respectively, defining a distance between the fixed light source and the plano-convex lens, wherein a curve variation of the convex curve composed of the coordinates is within ±1 millimeter; and (c) generating a parallel light beam from an convex end of said plano-convex lens, wherein when the plano-convex lens shifts within the distance between the fixed light source and the plano-convex lens, the light beam generated by the fixed light source is refracted as the parallel light beam from the convex end, whereby the light beam with the optimum angle is generated through the plano-convex lens from the fixed light source.

12. The method, as recited in claim 11, wherein a distance between a plane and a convex apex of the plano-convex lens is grater than or equal to 6 millimeter, and is smaller than or equal to 10 millimeter.

13. The method, as recited in claim 11, wherein the fixed light source is a light emitting diode.

14. The method, as recited in claim 11, wherein the convex curve of the plano-convex lens is scaled according to the coordinates.

15. The method, as recited in claim 12, wherein the convex curve of the plano-convex lens is adjustable based on the particular relationship set though the distance between the plane and the convex apex of the plano-convex lens and the coordinates (X, Y) of points of the plano-convex lens.

* * * * *